US010092113B2

(12) United States Patent
Longenecker et al.

(10) Patent No.: US 10,092,113 B2
(45) Date of Patent: Oct. 9, 2018

(54) COMBINATION NAPPER AND CHANGING TABLE ACCESSORY

(71) Applicant: ARTSANA USA, INC., Lancaster, PA (US)

(72) Inventors: Michael L. Longenecker, Lancaster, PA (US); Michael S. DeGrace, Red Lion, PA (US)

( * ) Notice: Subject to any disclaimer, the term of this patent is extended or adjusted under 35 U.S.C. 154(b) by 0 days.

(21) Appl. No.: 15/798,335

(22) Filed: Oct. 30, 2017

(65) Prior Publication Data

US 2018/0146795 A1 May 31, 2018

Related U.S. Application Data

(60) Provisional application No. 62/427,765, filed on Nov. 29, 2016.

(51) Int. Cl.

| | |
|---|---|
| ***A47D 7/00*** | (2006.01) |
| ***A47D 7/01*** | (2006.01) |
| ***A47D 5/00*** | (2006.01) |
| ***A47D 9/00*** | (2006.01) |

(52) U.S. Cl.

CPC ..... *A47D 7/01* (2013.01); *A47D 5/006* (2013.01); *A47D 7/002* (2013.01); *A47D 9/005* (2013.01)

(58) Field of Classification Search

CPC ..... A47D 7/00
USPC ..... 5/93.1, 97, 98.1, 99.1
See application file for complete search history.

(56) References Cited

U.S. PATENT DOCUMENTS

| | | | | |
|---|---|---|---|---|
| 5,918,329 | A * | 7/1999 | Huang | A47D 5/00 5/503.1 |
| 6,233,759 | B1 | 5/2001 | Warner, Jr. et al. | |
| 7,263,729 | B2 | 9/2007 | Paesang et al. | |
| 8,925,128 | B2 | 1/2015 | Fiore, Jr. et al. | |
| 8,943,622 | B2 | 2/2015 | Saint et al. | |
| 8,973,180 | B2 | 3/2015 | Zeng et al. | |
| 8,984,682 | B2 | 3/2015 | Zhao | |
| 9,078,530 | B2 | 7/2015 | Ingram et al. | |
| 9,089,225 | B2 | 7/2015 | Fiore, III et al. | |
| 9,351,587 | B2 | 5/2016 | Burns et al. | |
| 9,364,098 | B2 | 6/2016 | Fiore, III et al. | |
| 9,375,095 | B2 | 6/2016 | Fiore, Jr. et al. | |

(Continued)

*Primary Examiner* — Fredrick C Conley
(74) *Attorney, Agent, or Firm* — Patent Law Associates

(57) ABSTRACT

A reconfigurable accessory frame for use with an infant crib having a perimeter similarly sized to that of the top of the crib frame upon which it is used. The frame is foldable about an asymmetrically positioned transverse axis into one of the two positions. In the first position, the frame extends to substantially cover the open perimeter of the crib disposed underneath. Soft goods supported from the frame define a generally level surface that is convenient for changing an infant diaper along with a storage compartment disposed at one end. The level changing surface encompasses a majority of the area encompassed by the frame. In the second position, the frame is folded so that the end portion opposite of the storage compartment is moved into a positon adjacently above the remainder of the changing table surface. The design of the folding hinge elevates a portion of the frame and allows soft goods to hang downwardly toward and approaching the level of the soft goods defining the changing table surface to define a napper structure in the soft goods.

14 Claims, 11 Drawing Sheets

(56) References Cited

U.S. PATENT DOCUMENTS

| | | | |
|---|---|---|---|
| 9,675,183 | B2 | 6/2017 | Saint et al. |
| 2016/0286978 | A1 | 10/2016 | Sclare et al. |

* cited by examiner

COMBINATION NAPPER AND CHANGING TABLE ACCESSORY

CROSS-REFERENCE TO RELATED APPLICATIONS

This application claims the priority benefit of U.S. provisional patent application Ser. No. 62/427,765 filed on Nov. 29, 2016.

BACKGROUND OF THE INVENTION

This invention relates generally to accessories for the care of infants, and more particularly to an accessory for a portable crib frame that is easily convertible between a changing table and a napper.

Portable cribs and play yards are useful to contain and provide a safe environment for small children to sleep or play. These enclosures generally include side walls and a bottom floor made of fabric material or similar soft goods supported on a collapsible frame that allows them to be easily stored or transported.

Portability of infant care accessories is an increasingly important consideration among consumers. The continuing quest for portability and convenience has given rise to accessories designed to work with cribs and play yards to expand the utility of the base frames without duplicating the underlying supporting structures. These accessories not only expand basic utility but extend the duration that a basic crib frame may be used as the child grows.

SUMMARY OF THE INVENTION

Accordingly, the present invention, in any of the embodiments described herein, may provide one or more of the following advantages:

It is an object of the present invention to provide an accessory frame for use with an infant crib or child play yard capable of configuration as a changing table surface or an infant napper. The frame comprises a generally planar, rectangular upper frame that may be supported by positioning atop the upper frame of a crib or play yard frame. The perimeter of the upper accessory frame is similarly sized to that of the top of the crib frame. The frame is foldable about an asymmetrically positioned transverse axis into one of two positions. In the first position, the frame extends to substantially cover the open perimeter of the crib disposed underneath. Soft goods supported from the frame define a generally level surface that is convenient for changing an infant diaper along with a storage compartment disposed at one end. The level changing surface encompasses a majority of the area encompassed by the frame. In the second position, the frame is folded so that the end portion opposite of the storage compartment is moved into a positon adjacently above the remainder of the changing table surface. The design of the folding hinge elevates a portion of the frame and allows soft goods to hang downwardly toward and approaching the level of the soft goods defining the changing table surface to define a napper structure in the soft goods.

It is a still further object of the present invention to provide a reconfigurable napper and changing table frame for accessory use with an infant crib frame having a foldable frame that is positioned atop the crib frame and rests securely thereon in both the changing table and napper configurations.

It is a further object of the present invention to provide a reconfigurable accessory frame for use with an infant crib that in one configuration provides a changing table surface with a storage area at one end and in a second configuration provides a napper seat for an infant. Reconfiguring the accessory frame requires only folding the frame about a transverse folding axis and allowing the soft goods to under-hang the reconfigured frame.

It is a still further object of the present invention to provide a reconfigurable accessory frame for use with an infant crib that in one configuration provides a changing table surface and in a second configuration wherein reconfiguring requires a simple folding movement along a transverse folding axis provides a napper seat for an infant that is durable in construction, inexpensive of manufacture, carefree of maintenance, easily assembled, and simple and effective to use.

These and other objects are achieved in accordance with the present invention by providing a reconfigurable accessory frame for use with an infant crib. The perimeter of the upper accessory frame is similarly sized to that of the top of the crib frame. The frame is foldable about an asymmetrically positioned transverse axis into one of the two positions. In the first position, the frame extends to substantially cover the open perimeter of the crib disposed underneath. Soft goods supported from the frame define a generally level surface that is convenient for changing an infant diaper along with a storage compartment disposed at one end. The level changing surface encompasses a majority of the area encompassed by the frame. In the second position, the frame is folded so that the end portion opposite of the storage compartment is moved into a positon adjacently above the remainder of the changing table surface. The design of the folding hinge elevates a portion of the frame and allows soft goods to hang downwardly toward and approaching the level of the soft goods defining the changing table surface to define a napper structure in the soft goods.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Figure 1:
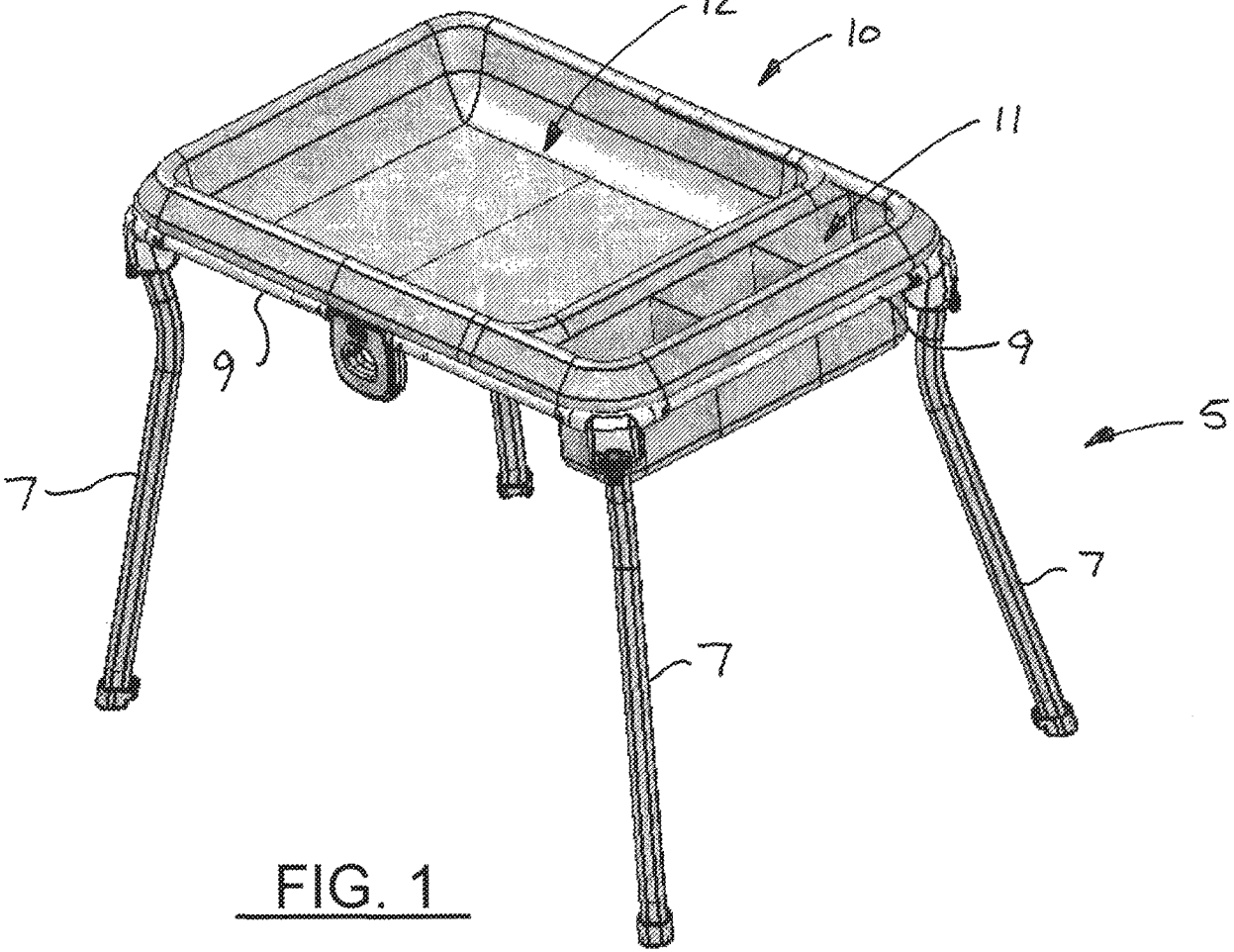
FIG. 1 is a perspective view of a conventional foldable crib frame supporting an accessory embodying aspects of the present invention, shown with the soft goods in place and in a first configuration for use as a changing table.

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the crib frame would normally rest on the floor or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Referring first to FIGS. 1 through 4, a crib frame 5 comprising a plurality of upstanding legs 7 supporting a generally level upper frame 9 is illustrated supporting a child care accessory 10 incorporating principles of the present invention. The accessory 10 is configured to rest atop the upper crib frame. The accessory perimeter 15 mimics the perimeter of the crib upper frame so that it substantially covers all of the area defined by the upper frame 9. The child care accessory 10 provides an infant changing table, shown in FIG. 1 that may be reconfigured by a user to provide an infant napper, shown in FIG. 2. While in the changing table configuration, the accessory frame and soft goods define a generally level surface 12 that occupies most of the area defined by the perimeter of the accessory frame. A storage area 11 is defined at one end of the accessory 10 adjacent to the changing table surface 12.

Connectors may be provided to securely connect and retain the accessory 20 to the crib frame 5.

FIGS. 5 through 11 depict the accessory 10 with soft goods removed to better illustrate the components comprising the underlying accessory frame 20. The accessory frame 20 comprises a plurality of frame members arranged to create a base portion 30 and a folding portion 40 that are hingedly connected and positionable in an unfolded state (shown in FIGS. 5 through 7) and a folded state (shown in FIGS. 8 through 11). The unfolded state corresponds to use of the accessory as a changing table; the folded state corresponds to use as a napper.

Figure 5:
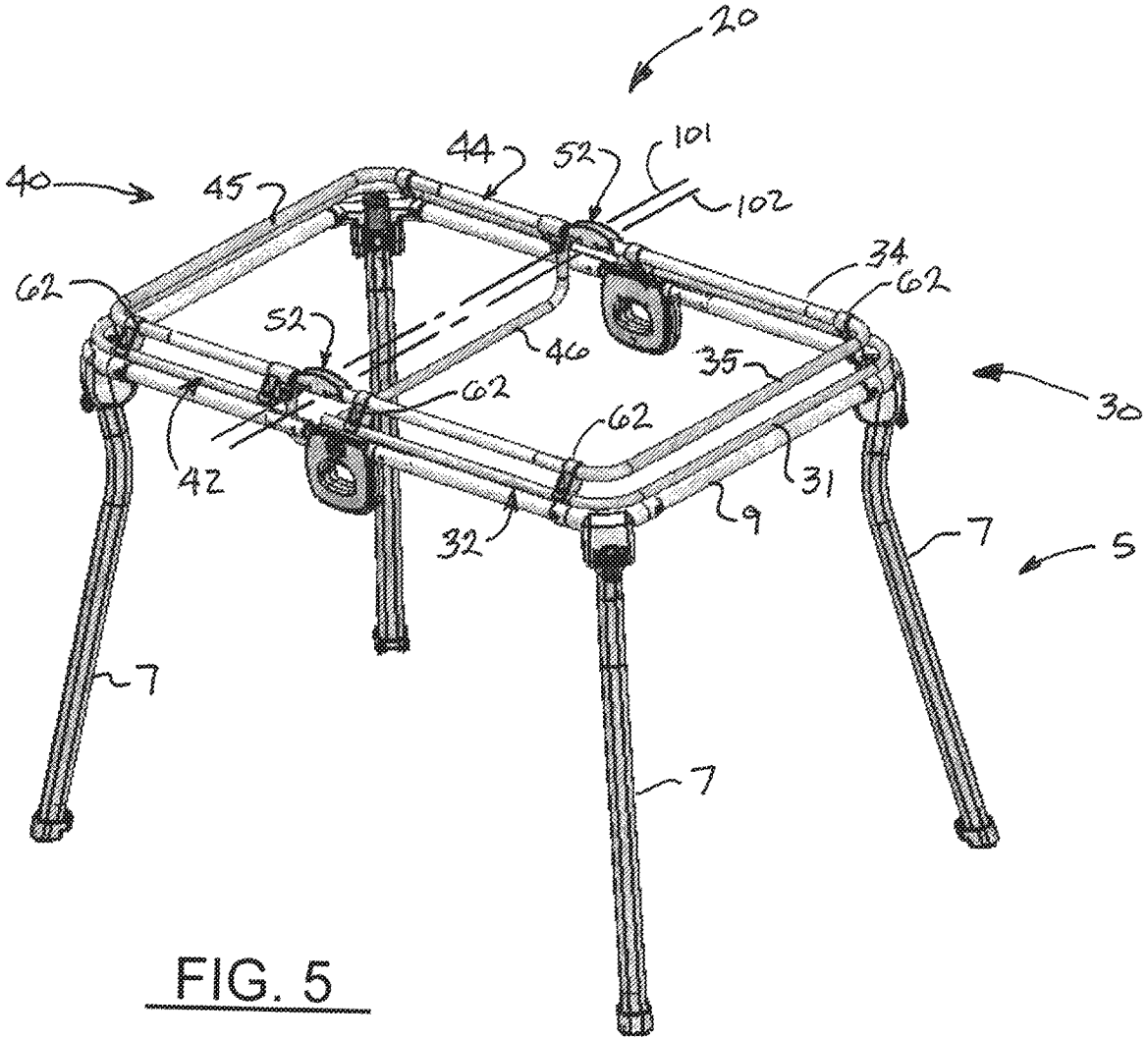
FIG. 5 is a perspective view of the crib and accessory frame of FIG. 1 shown with the soft goods removed.
Figure 6:
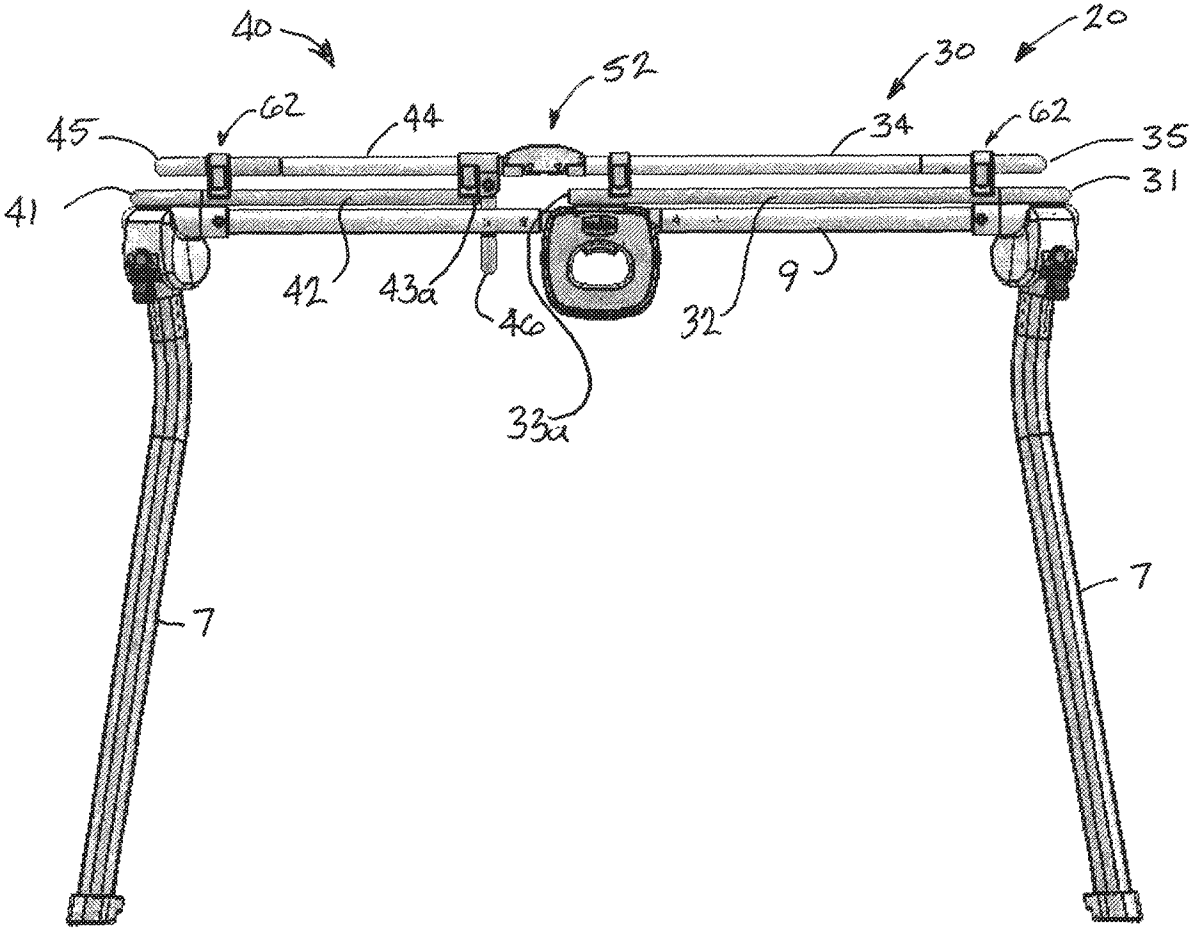
FIG. 6 is side view of the crib and accessory frames of FIG. 5.
Figure 7:
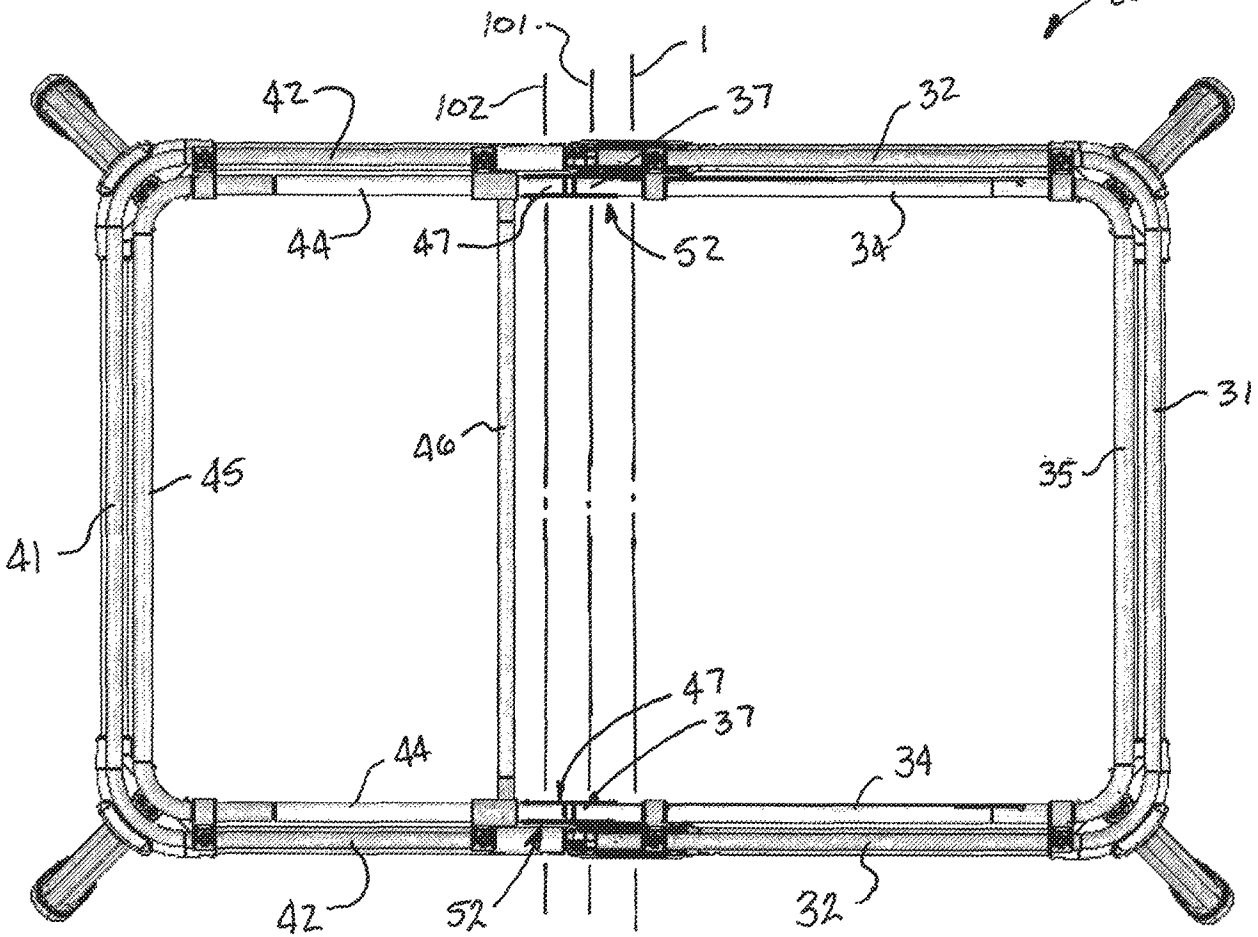
FIG. 7 is a plan view of the crib and accessory frames of FIG. 5.
Figure 8:
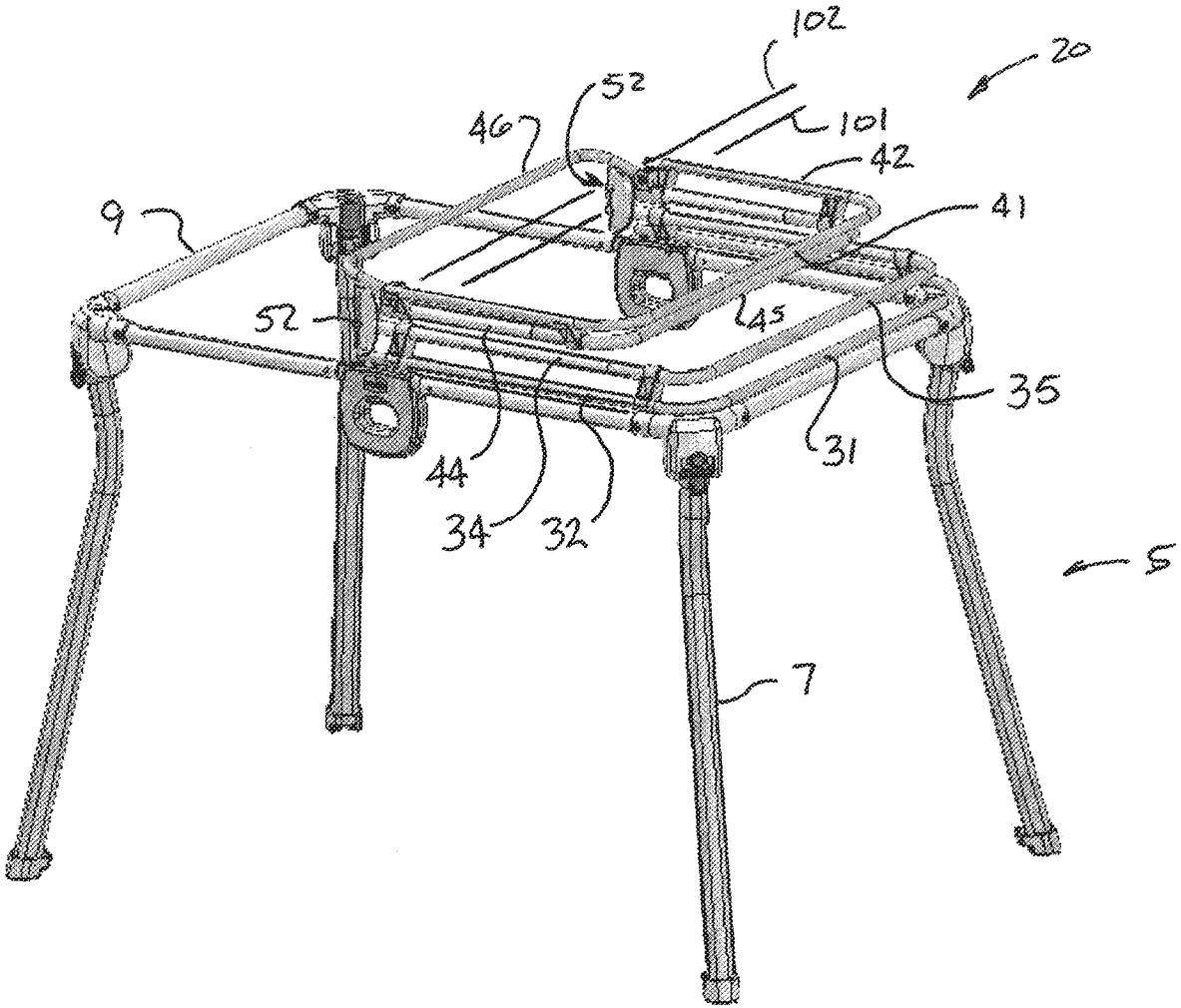
FIG. 8 is a perspective view of the crib and accessory frame shown in FIG. 2 wherein the soft goods are not illustrated.
Figure 9:
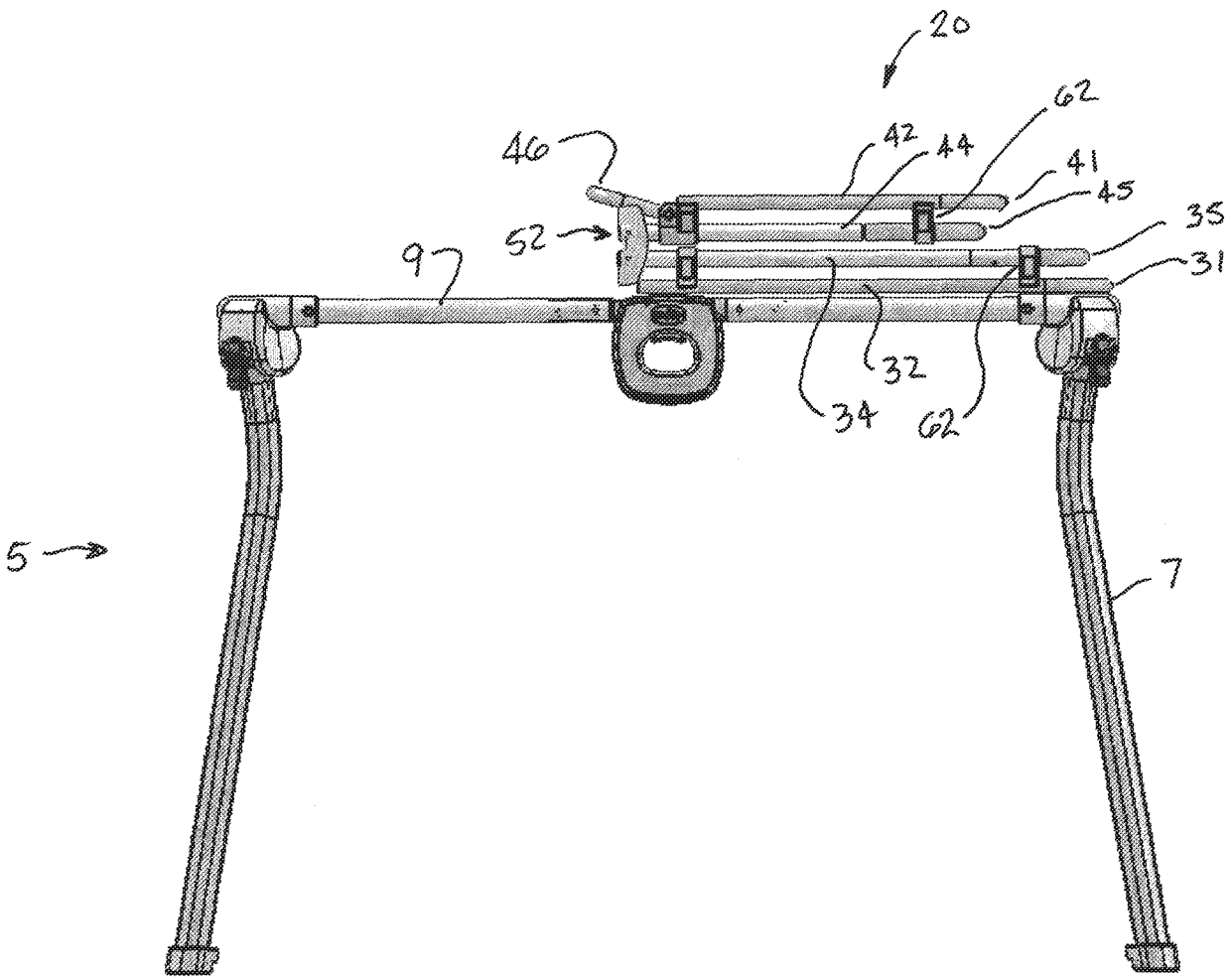
FIG. 9 is a side elevation view of the crib and accessory frame shown in FIG. 8.
Figure 10:
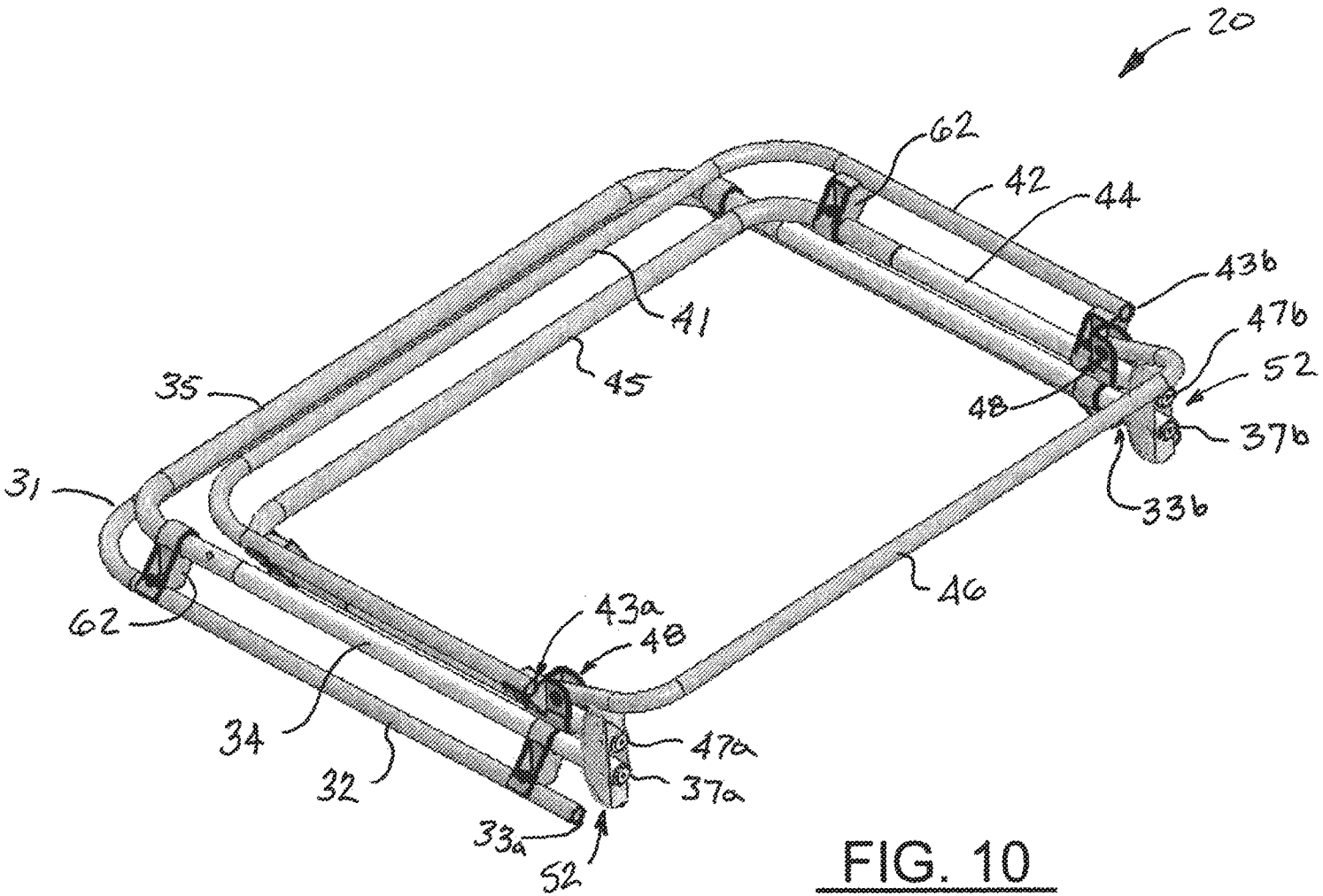
FIG. 10 is a perspective view of the accessory frame shown configured for use as a napper.
Figure 11:
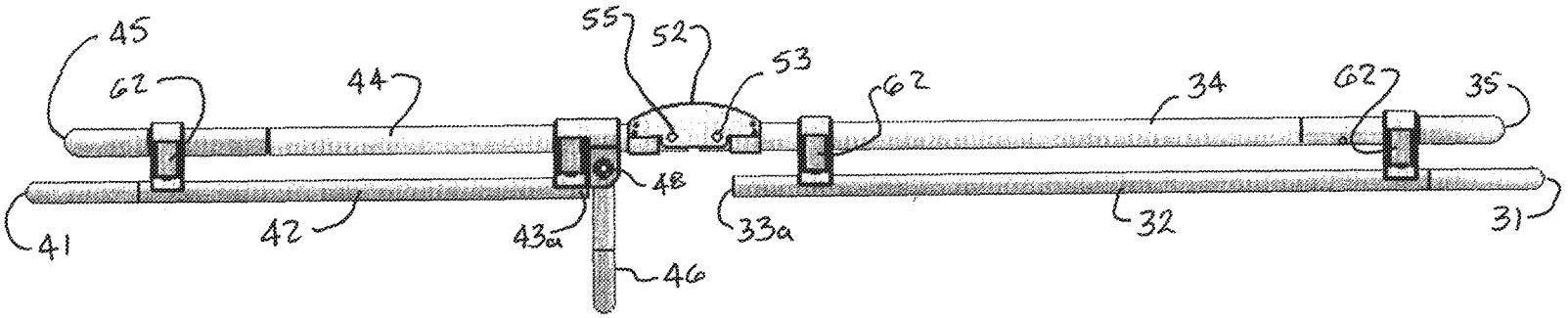
FIG. 11 is a side view of the accessory frame shown in FIG. 10 shown in the unfolded state.

Referring specifically to FIGS. 5 through 7 showing the accessory frame 20 in the unfolded state, the base portion 30 and the folding portion 40 each include support member 32, 42 that is configured to be positioned atop opposing side members of the upper frame 9 of the supporting crib when the accessory frame is in the unfolded state. The respective support members 32, 42 are generally U-shaped, each having respective lateral ends 31, 41 that rest upon opposite ends of the top rail 9 and open leg ends 33*a*, 33*b*, 43*a*, 43*b* (FIG. 10) that rest upon opposite sides of the top rail 9 and are proximately opposed, but not connected, to define a generally planar perimeter generally matching the perimeter of the crib upper frame 9.

The base portion 30 and the folding portion each further include a U-shaped upper member 34, 44 that is upwardly displaced from the plane defined by the support members 32, 42. A plurality of spacers 62 are provided to attach the upper members 34, 44 to their respective support members 32, 42. The upper members 34, 44 may also be configured as generally U-shaped to match the arrangement of the support members, but it is preferably that the perimeter defined by the upper members 34, 44 be slightly smaller than the support member perimeter.

The upper members 34, 44 also include leg ends 37*a*, 37*b*, 47*a*, 47*b* that are proximately opposed and connected by hinge members 52 and upper lateral ends 35, 45 defining a width dimension. The hinge members 52 are preferably off-set hinges having a first hinge 53 at the leg ends 37*a*, 37*b* of the support portion upper member 34 and a second hinge 55 at the leg ends 47*a*, 47*b* of the folding portion upper member 44, the hinges 53, 55 being arranged to allow pivoting about parallel folding axes 101, 102 so that the folding portion 40 may be moved to a position above the base portion 30 and the upper members 44 of the folding portion 40 are parallel and adjacent to the upper member 34 of the base portion 30. The separation of the folding axes 101, 102 is sufficient to allow the folding portion upper member 44 to be aligned parallel to the base portion upper member 34 when folded, an alignment not achievable using a single folding axis hinge member. Using an offset, single pivot axis hinge positions a portion of the hinge above the perimeter plane formed by the upper frame members.

Figure 2:
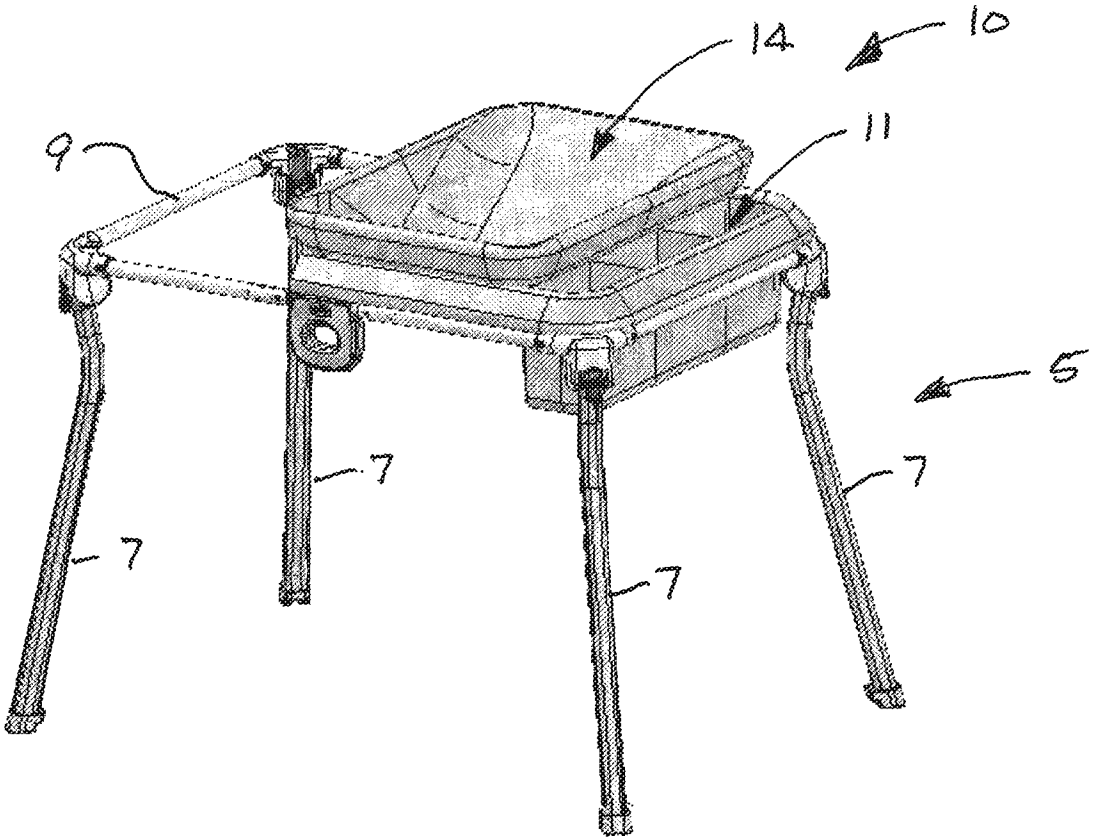
FIG. 2 is a perspective view of the crib and accessory shown in FIG. 1 wherein the accessory frame is reconfigured for use as a napper.
Figure 3:
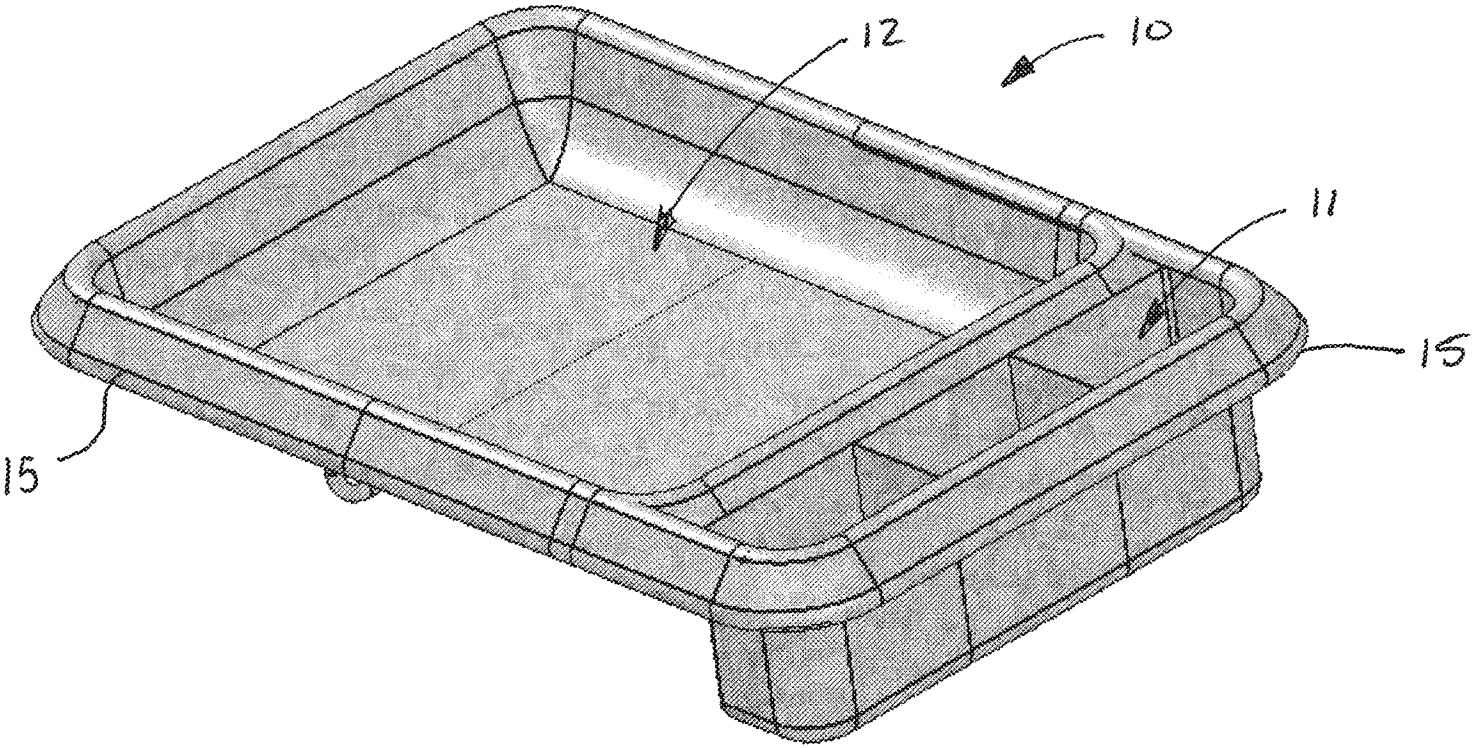
FIG. 3 is a perspective view of the accessory of FIG. 1, showing only the accessory frame configured for use as a changing table with soft goods in place.
Figure 4:
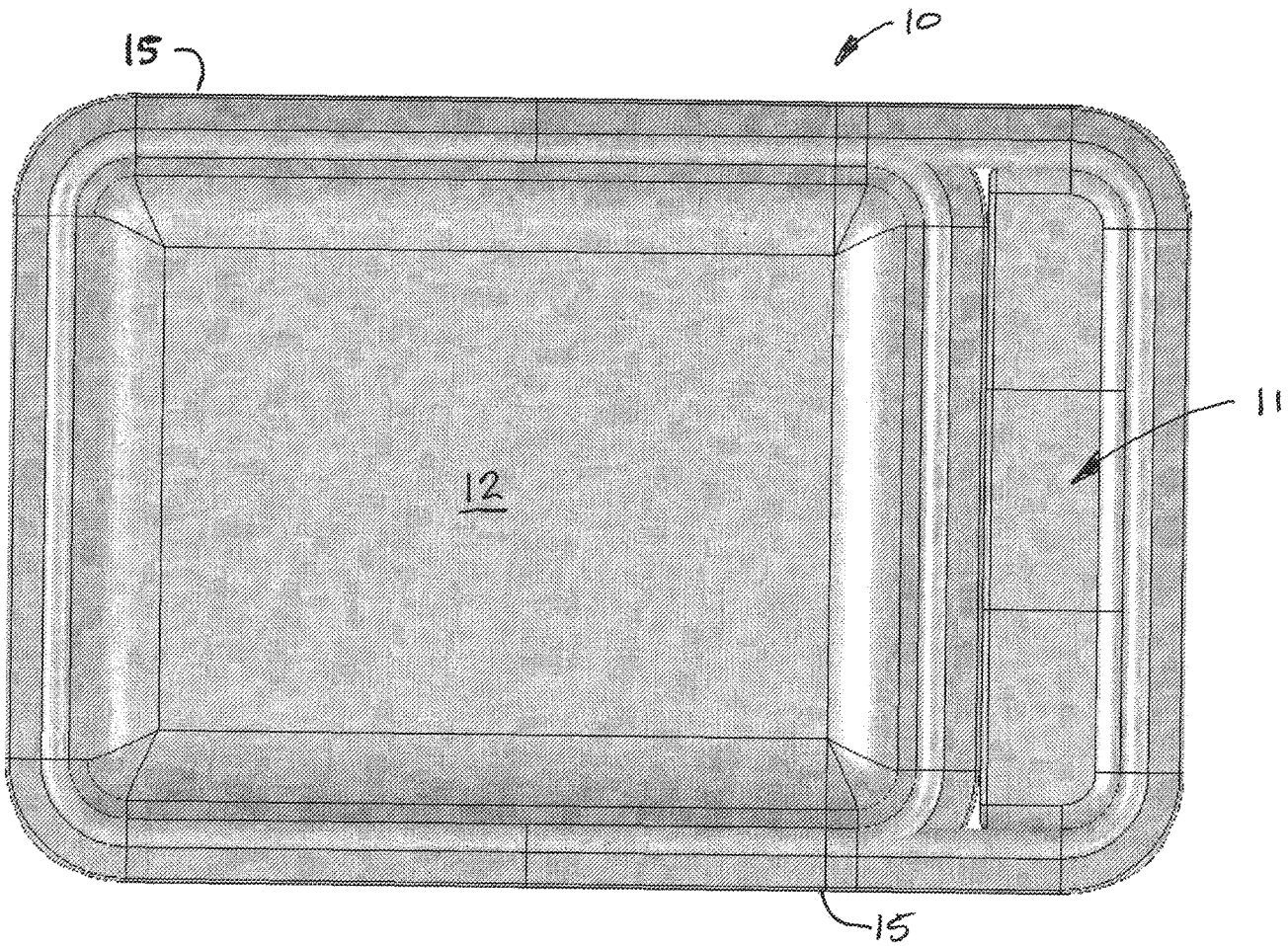
FIG. 4 is a plan view of the crib accessory of FIG. 3.

The folding axes 101, 102 are asymmetrically positioned in relation to the length (relative to centerline 1, FIG. 7) of the accessory frame 20 so that location of the lateral end 41 of the folding portion 40 is inwardly positioned in relation to the lateral end 31 and upper lateral end 35 of the base portion when the accessory frame is in the folded state. Referring to FIGS. 2 and 7, the extent of the asymmetry should be sufficient to maintain accessibility of the storage area 11 when the accessory frame is in the folded state.

Figure 12:
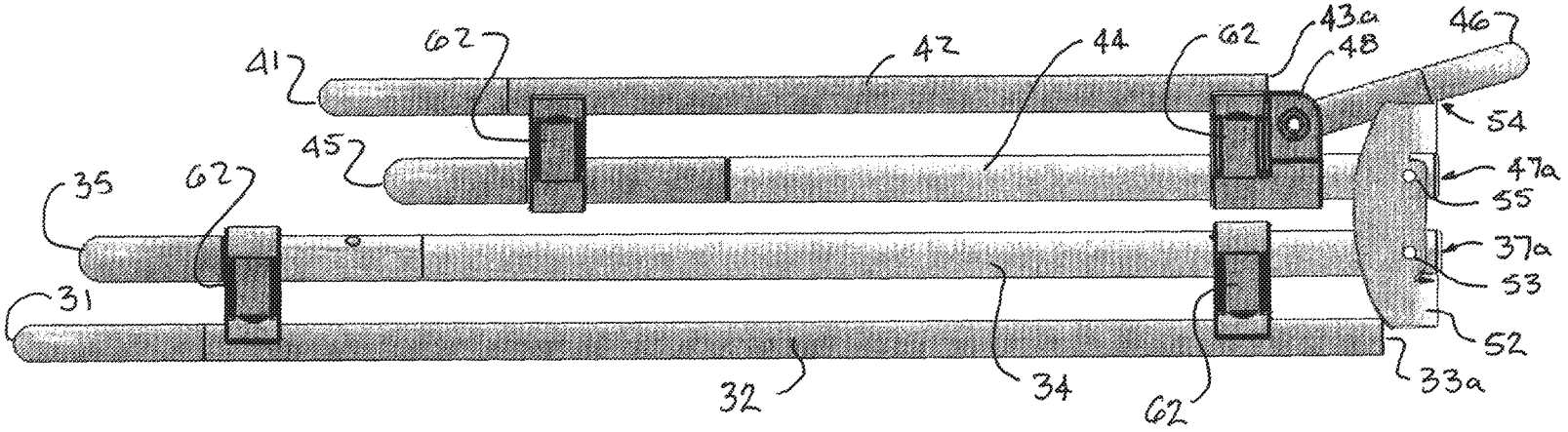
FIG. 12 is a side view of the accessory frame shown in FIG. 10 shown in the folded state.

The folding portion 40 further comprises a generally U-shaped napper end tube 46 which is pivotally coupled at its respective leg ends 46*a* by a napper hinge 48 to respective opposing leg ends 47*a*, 47*b* of the upper member 44 of the folding portion 40 adjacent to the connection of the upper leg ends 47*a*, 47*b* to the folding hinges 52. The napper hinges 48 enable pivoting movement of the napper end tube 46 between a first (lowered) position, best illustrated in FIG. 11 wherein the napper end tube is generally perpendicularly oriented to the plane of the upper member 44, and second (raised) position, best illustrated in FIG. 12 wherein the napper end tube 46 is angled in relation to the plane of the upper member 44.

Pivoting movement toward the first position may be limited by interaction between the napper end tube 46 and the open leg ends 43 of the folding portion base support member 42. In this position, the napper support tube 46 extends downwardly from the upper frame 44 to a position generally below the plane defined by the upper frame 9 and also below the level generally occupied by the soft goods that define the changing table level surface (Ref. #12 in FIGS. 3 and 4).

The napper end tube 46 may also laterally stabilize the accessory frame 20 when positioned atop the crib frame 5 as the leg ends 46*a* preferably extend below the plane of the upper crib frame and are configured with a slightly narrower width which limits lateral movement of the accessory frame while it rests atop the crib frame.

Pivoting of the napper end tube 46 toward the second position generally occurs as the folding portion 40 is moved toward the folded state. The range of pivoting movement of the napper end tube 46 toward the second position is limited by interaction between the napper end tube 46 and a support edge 54 of the folding hinges 52. When the napper end tube 46 is in the second position and the accessory frame 20 is in the folded state, the napper end tube 46 spans the transverse width of the accessory frame at a height consistent with the height of the base support member 42 of the folding portion 40 to provide a complete perimeter frame from which the napper soft goods may be suspended.

Movement of the various accessory frame members is generally manually managed as the frame is moved between the folded and unfolded states. The attached soft goods may also guide movement of the various frame members during accessory frame reconfiguration.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An accessory frame for use with a child's crib frame, the crib frame having a top rail defining a generally horizontal, rectangular perimeter, the accessory frame comprising:

a base frame portion having an upper member and a spaced apart and parallel lower support member configured to rest partially upon the top rail;

a folding frame portion having an upper member and a spaced apart and parallel lower support member, the folding frame portion upper member being hingedly connected at a proximal end to a proximal end of the base frame portion upper member and movable about a generally transverse hinge axis between an unfolded position in which the respective upper members and lower support of the base and folding frame portions are generally adjacent and co-planar, and a folded position in which the folding frame portion is pivoted upwardly to a position adjacently above the base frame portion;

the base and folding frame portions each having a distal end spaced apart from the hinged connection, the displacement of the base frame portion distal end from the hinged connection being greater than the displacement of the distal end of the folding frame portion therefrom such that access to a portion of the base frame portion remains unobstructed from above by the folding frame portion when in the folded position; and a moveable frame portion coupled to the folding frame portion and configured for pivoting movement about an axis parallel to the hinge axis between a lowered position and a raised position, the moveable frame portion moving toward the lowered position when the accessory frame is unfolded and toward a raised position as the folding frame portion is moved into the folded position, the moveable frame portion and the folding frame portion defining a generally planar peripheral support positioned above the base frame portion when the moveable frame portion is in the raised position and the folding frame portion is in the folded position.

2. The accessory frame of claim 1, wherein the perimeter defined by the respective upper members of the base and folding frame portions has smaller length and width dimensions than those of the perimeter defined by the respective lower support members of the base and folding frame portions.

3. The accessory frame of claim 1, wherein the hinged connection includes first and second pivoting connections connected to base and folding portions, respectively, the pivoting connections defining first and second folding axes each parallel to the hinge axis.

4. The accessory frame of claim 3, wherein the raised and lowered positions of the moveable frame portion are defined and limited by travel stops.

5. The accessory frame of claim 4, wherein the travel stop for the lowered position of the movable frame portion is contact between the movable frame portion and the lower support member of the folding frame portion and the travel stop for the raised position of the moveable frame portion is contact between the movable frame portion and the hinged connection.

6. An accessory frame for use with a child's crib frame, the crib frame having a top rail defining a generally rectangular perimeter, the accessory frame comprising:

a base frame portion having an upper structure and a spaced apart and parallel lower support structure;

a folding frame portion having an upper structure and a spaced apart and parallel lower support structure, the upper structure being hingedly connected to the upper structure of the base frame portion and moveable about a generally transverse hinge axis between an unfolded position and a folded position, the lower support structures of the base and folding frame portions being adjacently coplanarly arranged to define a generally planar frame perimeter having a length generally matching length of the crib frame when in the unfolded position, the upper structures of the base frame portion and the folding frame portion also being coplanarly arranged when in the unfolded position, the upper structure of the folding frame portion being positioned adjacently above the upper structure of the base portion when moved to the folded position; and a moveable frame portion coupled to the folding frame portion and configured for pivoting movement about an axis parallel to the hinge axis between a lowered position and a raised position, the moveable frame portion moving toward the lowered position when the accessory frame is unfolded and toward a raised position as the folding frame portion is moved into the folded position, the moveable frame portion and the folding frame portion defining a generally planar peripheral support.

7. The accessory frame of claim 6, wherein the hinged connection is asymmetrically positioned such that the displacement of a distal end of the base frame portion from the hinged connection is substantially greater than the displacement of a distal end of the folding frame portion from the hinged connection such that access to a portion of the base frame portion remains unobstructed from above by the folding frame portion when in the folded position.

8. The accessory frame of claim 7, wherein the movable frame portion is pivotally coupled to the upper member of the folding frame portion.

9. The accessory frame of claim 8, wherein the raised and lowered positions of the moveable frame portion are defined and limited by travel stops.

10. The accessory frame of claim 9, wherein the travel stop for the lowered position of the movable frame portion is contact between the movable frame portion and the lower support member of the folding frame portion and the travel stop for the raised position of the moveable frame portion is contact between the movable frame portion and the hinged connection.

11. An accessory frame for use with a child's crib frame, the crib frame having a top rail defining a generally rectangular perimeter including a pair of generally opposing sides and a pair of generally opposing ends, the accessory frame comprising:

a base frame portion having an upper structure and a spaced apart and parallel lower support structure configured to be supported by the top rail;

a folding frame portion having an upper structure and a spaced apart and parallel lower support structure, the folding frame portion upper structure being hingedly connected to the base frame portion upper structure and moveable about a transverse hinge axis between an unfolded position and a folded position, respective upper structures and respective lower support structures being co-planarly aligned when in the unfolded position, the folding frame portion being supported by at least the opposing sides of top rail when in the unfolded position and being pivoted upwardly about the hinge axis to a position adjacently above the base frame portion when in the folded position; and a moveable frame portion coupled to and extending between opposing sides of the folding frame portion, the moveable frame portion configured for pivoting movement about an axis parallel to the hinge axis between a lowered position and a raised position, the moveable frame portion moving by gravity toward the lowered position when the accessory frame is unfolded whereupon a portion of the moveable frame portion is disposed below a plane defined by the perimeter of the frame, the moveable frame portion moving toward a raised position as the folding frame portion is moved into the folded position, the moveable frame portion and the folding frame portion defining a peripheral support generally defining a support plane disposed above the base frame portion when the moveable frame portion is in the raised position and the folding frame portion is in the folded position.

12. The accessory frame of claim 11, wherein the hinged connection is asymmetrically positioned such that the displacement of a distal end of the base frame portion from the hinged connection is substantially greater than the displacement of a distal end of the folding frame portion from the hinged connection such that access to a portion of the base frame portion remains unobstructed from above by the folding frame portion when in the folded position.

13. The accessory frame of claim 12, wherein the moveable frame portion is coupled to the upper member of the folding frame portion.

14. The accessory frame of claim 13, wherein the hinged connection includes first and second pivoting connections connected to base and folding portions, respectively, the pivoting connections defining first and second folding axes each parallel to the hinge axis.

* * * * *